US006189654B1

(12) United States Patent
Bailey et al.

(10) Patent No.: US 6,189,654 B1
(45) **Date of Patent: *Feb. 20, 2001**

(54) EXTENSION LADDER

(75) Inventors: William Bailey, deceased, late of Queensland; by Robin E. Bailey, executrix, Brisbane, both of (AU)

(73) Assignee: Bailey Northern Holdings Pty Ltd., Queensland (AU)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/293,921

(22) Filed: Apr. 19, 1999

(30) Foreign Application Priority Data

Apr. 21, 1998 (AU) ..... PP3079

(51) Int. Cl.[7] ..... E06C 1/12
(52) U.S. Cl. ..... 182/211; 182/212
(58) Field of Search ..... 182/209–213

(56) References Cited

U.S. PATENT DOCUMENTS

| | | | | |
|---|---|---|---|---|
| 418,046 | * | 12/1889 | Mitchell | 182/212 |
| 925,822 | * | 6/1909 | Mote | 182/213 |
| 1,113,413 | * | 10/1914 | Conabee | 182/211 |
| 2,760,706 | * | 8/1956 | Pearl | 182/211 |
| 2,944,625 | * | 7/1960 | Shore | 182/209 |
| 2,957,543 | * | 10/1960 | Carson | 182/211 |
| 3,343,630 | * | 9/1967 | Redman | 182/209 |
| 3,420,333 | * | 1/1969 | Atchison | 182/211 |
| 3,502,175 | | 3/1970 | Bullock . | |
| 3,902,569 | | 9/1975 | Bair . | |
| 3,935,926 | | 2/1976 | Butler . | |
| 4,926,964 | * | 5/1990 | Herrin | 182/209 |
| 5,000,289 | * | 3/1991 | Sanchez | 182/209 |
| 5,515,942 | * | 5/1996 | Woodfield | 182/194 |

FOREIGN PATENT DOCUMENTS

| | | | | |
|---|---|---|---|---|
| 2927257 | | 1/1981 | (DE) . | |
| 29713340 | | 4/1998 | (DE) . | |
| 354025 | * | 9/1905 | (FR) | 182/213 |
| 1922 | * | 1/1899 | (GB) | 182/211 |
| 25723 | * | 12/1899 | (GB) | 182/213 |
| 18199 | * | 8/1903 | (GB) | 182/212 |
| 1457149 | | 12/1976 | (GB) . | |
| 318893 | * | 7/1934 | (IT) | 182/213 |

* cited by examiner

*Primary Examiner*—Alvin Chin-Shue
(74) *Attorney, Agent, or Firm*—Nixon & Vanderhye P.C.

(57) ABSTRACT

An extension ladder consisting of a lower ladder section and an upper ladder section secured to one another so that the upper ladder section can be extended relative to the lower ladder section using a ladder extension rope. Each ladder section has the same width and each has a pair of spaced stiles with rungs. A clutch member extends between the ladder sections and is movable between a locked position, for mounting the upper ladder section at a desired extension relative to the lower ladder section, and a released position. A clutch locking mechanism biases the clutch member into the locked position. The stiles of each ladder section has formations for securing the sections relative to one another, and enable the upper section to be extended and retracted in relation to the lower ladder section.

19 Claims, 12 Drawing Sheets

EXTENSION LADDER

SUMMARY OF THE INVENTION

This invention relates to a ladder. In particular, the invention concerns an extension ladder.

Extension ladders typically consist of a lower ladder section and an upper ladder section secured to one another so that the upper ladder section may be extended relative to the lower ladder section. The upper ladder section from the perspective of a user, is mounted in front of the lower ladder section and extends over the lower ladder section.

Each ladder section has a pair of spaced stiles with rungs extending between them. The upper ladder section usually has a width less than the width of the lower ladder section. Where this is so, the rungs of the upper ladder section are of a shorter length than the rungs of the lower ladder section.

A clutch mechanism having spaced clutch arms linked by a clutch bar is present for locking the upper ladder section at a desired extension relative to the lower ladder section. The clutch arms engage over rungs of the lower section and are pivotally mounted to the upper ladder section. In use the location of the pivot is above those parts of the clutch arms which engage over the selected rung of the lower ladder section. A rope and pulley arrangement is used to lift the upper section to release the clutch arms from the rung over which they locate and to then raise or lower the upper ladder section. The clutch arms are allowed to return to a locked position under the influence of gravity.

Such known ladders are not as strong as they could be because the ladder sections are of different widths. In addition the locking of the clutch arms under gravity does not provide a positive locking action.

By having the upper ladder section in front of the lower ladder section there is a danger that a user may miss a rung as he progresses downwardly over the transitional zone from the lower end of the upper ladder section onto the lower ladder section.

It is an object of the present invention to at least minimise some of the disadvantages referred to above According to one aspect there is provided an extension ladder having a first ladder section adapted to provide a lower ladder section in use, a second ladder section adapted to provide an upper ladder section in use, the upper and the lower ladder sections each having a pair of spaced ladder stiles with rungs extending between each said stile of a pair of stiles at locations along the ladder sections and both said ladder sections having the same width, the lower ladder section in use being located either forwardly or rearwardly of the upper ladder section, a clutch mechanism including clutch arms extending between the ladder sections and movable between a locked position for maintaining the upper ladder section at a desired extension relative to the lower ladder section and a released position allowing for movement of the sections relative to one another and a clutch locking mechanism for biasing the clutch arms into the locked position, the stiles of each ladder section having formations for securing the sections relative to one another and allowing the upper section to be extended and retracted relative to the lower ladder section.

The formation on the stiles for securing the ladder sections to one another may consist of complementary interlocking projections and recesses which allow for relative sliding movement of the ladder sections while still securing the sections to one another. The formation in one embodiment may be provided along facing edges of the stiles in each ladder section.

In one embodiment the formations are continuous and extend along the length of the stiles. Preferably, the formations include interlocking flanges extending along the stiles. The flanges on one stile of one of the ladder section are preferably oppositely directed to the flanges of the associated stile in the other ladder section. Preferably, each stile has a pair of interlocking flanges and the flanges of the stiles are arranged in an interleaving fashion to secure the stiles to each other.

If desired, a friction reducing lining or insert may be present between the interlocking flanges of two stiles to not only assist the relative sliding action of the ladder sections but also to inhibit relative lateral movement of the stiles. In this way the tendency for the stiles to rattle may be minimised.

The ladder of the invention has a lower ladder section arranged forwardly or rearwardly of an upper ladder section. Each ladder section has two spaced longitudinally extending ladder stiles with a plurality of rungs arranged between the stiles and at spaced locations along the length of the stiles The rungs may be present at any suitable spaced locations along the stiles either evenly spaced, unevenly spaced or at irregular spacings along the length of the stiles. It is preferred that the rungs be evenly spaced.

The stiles may have any suitable shape in transverse section. Preferably the stiles have a longitudinally extending web with the securing formation along one edge of the web. The other edge may be provided with a strengthening formation to lend rigidity to the ladder. The strengthening formation may be a strengthening flange. Alternatively an enclosed formation may be present along the other edge of the web to strengthen the ladder. Preferably, the enclosed formation is substantially rectangular in transverse cross section although other shapes are not excluded.

At least lower ends of the stiles in each ladder section may be provided with feet inserts. The feet inserts may present inclined ground engaging surfaces. For protecting a wall against which the ladder may stand or for aesthetic purposes, feet inserts may also be provided at upper ends of the stiles of both ladder sections. The feet inserts are preferably secured to the webs of the stiles. Preferably, the inserts are secured to outer faces of the webs.

The ladder sections may be provided with strengthening braces. Preferably strengthening braces are present adjacent to ends of the ladder sections The strengthening braces may consist of a pair of diagonal strengthening struts extending between the stiles of the ladder sections.

The ladder has a clutch mechanism pivotally movable between a locked position which maintains the ladder sections at a desired extension relative to one another and a released position which allows the sections to slide relative to one another.

The clutch mechanism may include two transversely spaced clutch arms fixed to a mounting axle extending across the ladder. The clutch arms and the axle are preferably secured to the lower ladder section and the axle is mounted for rotation relative to that ladder section.

The clutch mechanism may include a clutch release cord, rope, wire or chain for moving the clutch arms between the two positions mentioned above. The clutch release cord may be secured to one of the clutch arms. The other end of the clutch release cord is preferably anchored to the lower ladder section at a location spaced from the arm. The clutch arms may be mounted to the lower ladder section adjacent an upper end of the lower ladder section and the other end of the clutch release cord may be anchored to a lower most rung of the lower ladder section.

The clutch arms may engage with rungs of the ladder. Preferably the arms engage with a rung of each of the ladder sections. The location at which the arms are connected to the lower ladder section may either be above or below the rungs with which the arms may engage. Preferably, the location is below the rungs with which the arms engage.

The locking mechanisms biases the clutch arms into their locked position. The locking mechanism may have a spring for biasing the arms. In one embodiment the locking mechanism includes a gear associated with the axle which may be influenced by the spring to bias the arms. Preferably, the spring acts upon a rack which is in engagement with the gear.

The ladder may have a ladder extension rope or cord for extending and retracting the upper ladder section relative to the lower ladder section. The ladder extension rope may extend between the two ladder sections. In one embodiment the ladder extension rope is anchored to rungs of the ladder sections. The ladder extension rope may be anchored to the lower most rungs of both ladder sections. In one embodiment a pulley is present adjacent an upper end of the lower ladder section and the ladder extension rope is trained over the pulley.

BRIEF DESCRIPTION OF THE DRAWINGS

A particular preferred embodiment of the invention will now be described by way of example with reference to the drawings in which.

DESCRIPTION OF THE PREFERRED EMBODIMENTS

Figure 1:
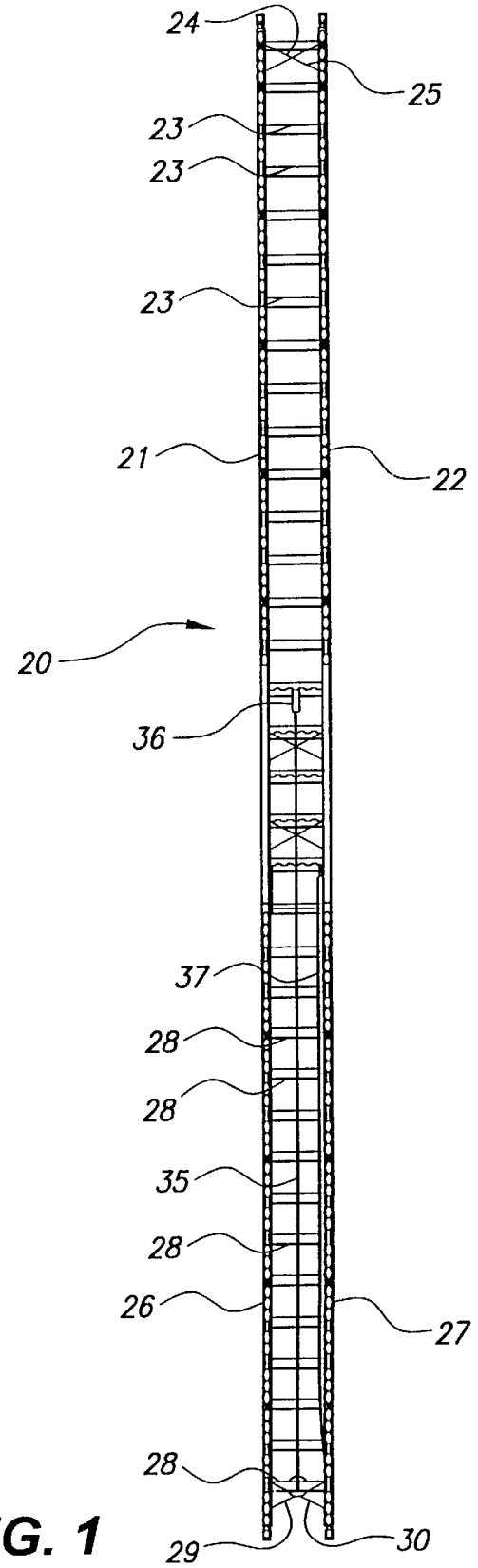
FIG. 1 is a front elevational view of a ladder according to an embodiment of the invention shown in its fully extended position.
Figure 2:
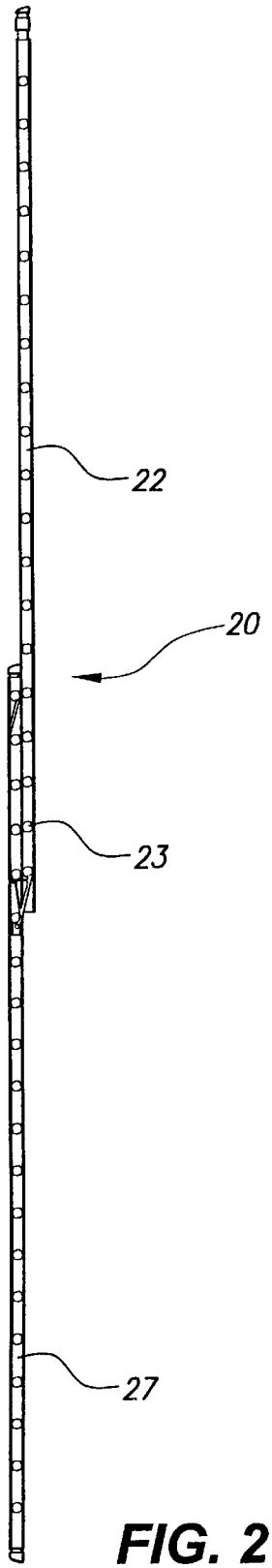
FIG. 2 is a side elevational view of the ladder of FIG. 1.

FIGS. 1 and 2 show a ladder 20 having an upper ladder section including a pair of ladder stiles 21, 22 and rungs 23 extending between the stiles 21, 22. Diagonal brace members 24, 25 extend between the stiles 21, 22 at an upper end thereof. The ladder 20 has a lower ladder section including a pair of ladder stiles 26, 27 and rungs 28 extending between the stiles. Diagonal brace members 29, 30 extend between the stiles at a lower end thereof. A ladder extension rope or cord 35 is anchored to a lowermost rung 28 arid is trained over a pulley 36 secured to a rung 28 near an upper end of the lower ladder section. The other end of the ladder extension rope 25 is anchored to a lowermost rung 23 of the upper ladder section. This rope 25 is used to extend the upper ladder section relative to the lower ladder section and to retract the upper ladder section in a controlled manner. A clutch release cord or rope 37 extends between the lowermost rung 28 and a clutch mechanism (not visible in FIGS. 1 and 2).

Figure 3:
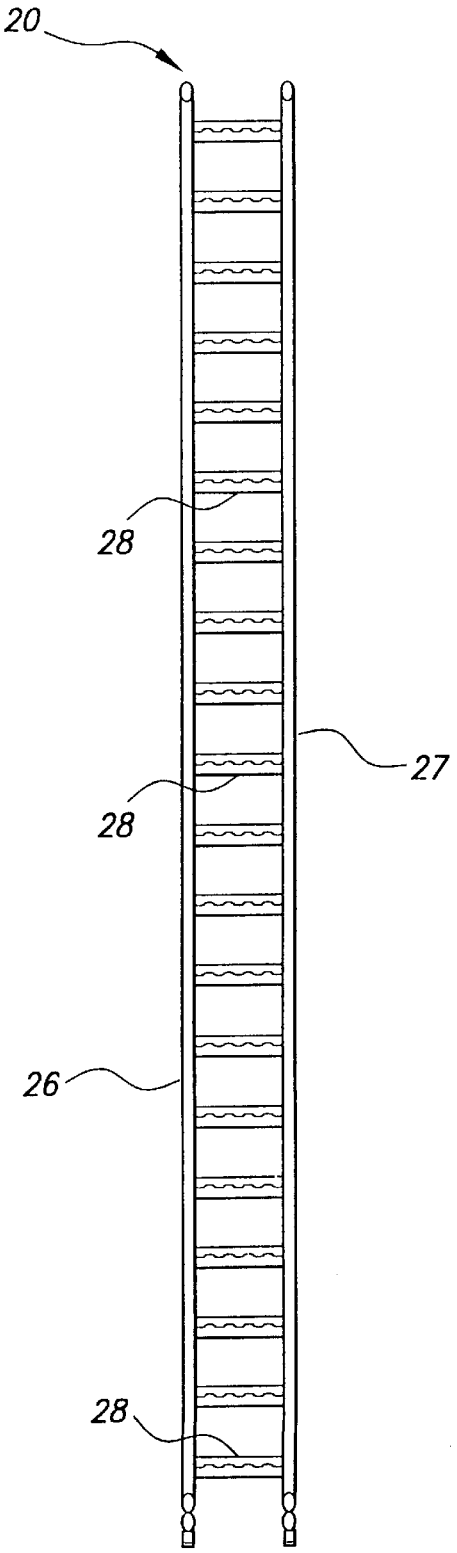
FIG. 3 is a front elevational view of the ladder of FIG. 1 shown in its fully retracted position.
Figure 4:
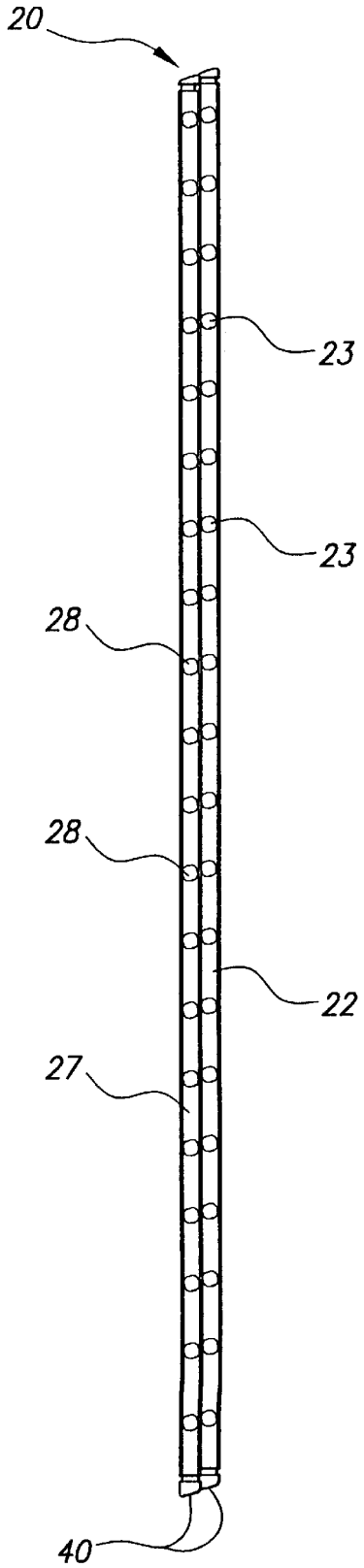
FIG. 4 is a side elevational view of the ladder of FIG. 3.

FIGS. 3 and 4 show the ladder sections in the retracted position. The lower ends of the ladder sections are provided with feet inserts 40 which present an inclined ground engaging surface.

Figure 5:
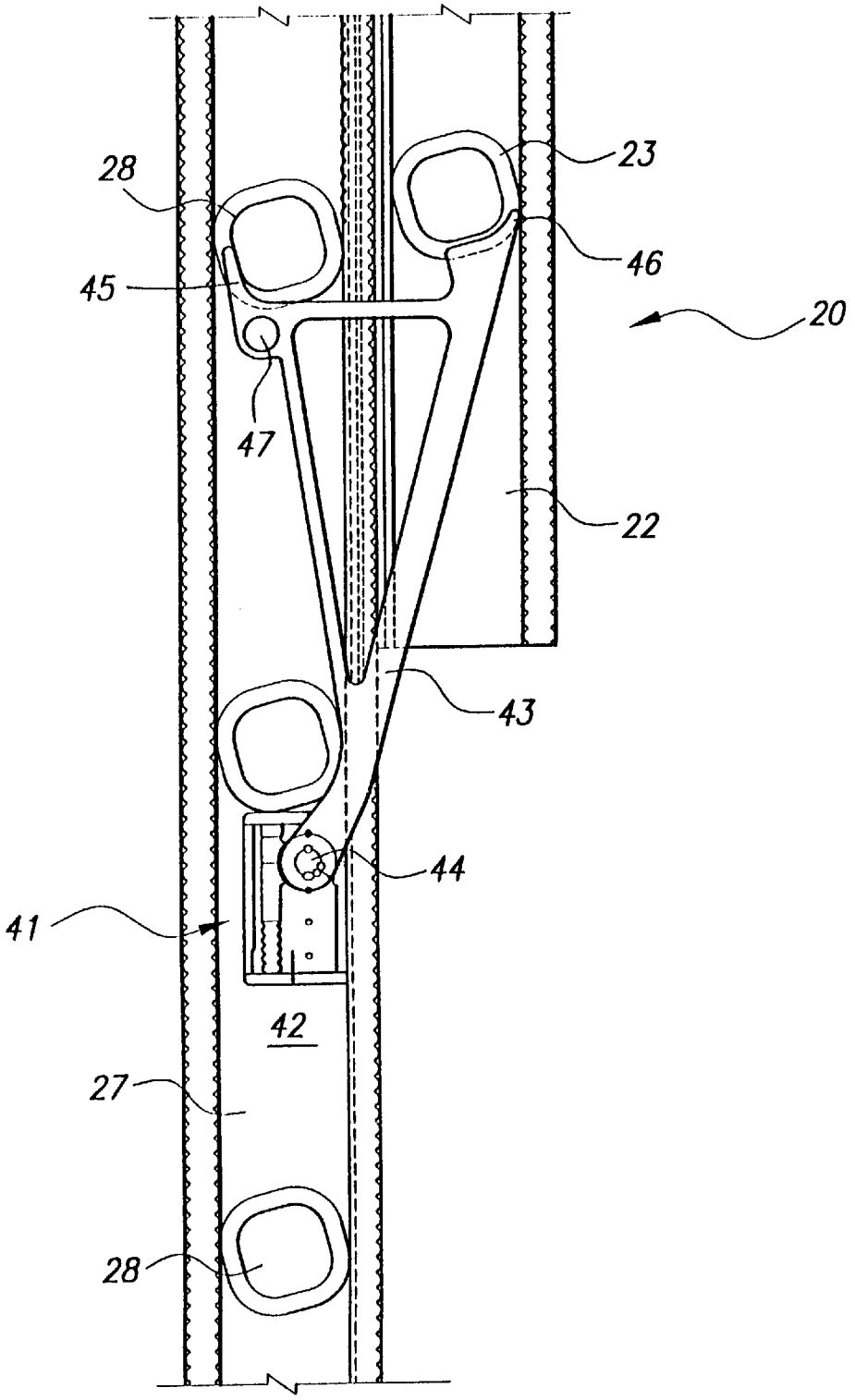
FIG. 5 is a detailed side elevational view of the ladder of FIGS. 1 and 2.

FIG. 5 shows details of a portion of the ladder 20 of FIGS. 1 to 4. This Figure shows a clutch locking mechanisms 41 mounted to a web 42 of the stile 27 of the lower ladder section. The locking mechanism 41 has a pair of clutch arms 43 (only one of which is visible in this view) mounted to it about an axle 44 for pivotal movement about an axis extending along the axle 44. The arms 43 each have two upwardly directed rung engaging portions 45, 46. Portions 45 and 46 engage partway around rung 28 of the lower ladder section and around rung 23 of the upper ladder section respectively.

FIG. 5 shows the clutch arms 43 in their locked position with the ladder 20 in its fully extended position. The clutch arms 43 support the upper ladder section and transfer the weight of that section to the lower ladder section via axle 44. The mechanisms 41 biases the clutch arms 43 into the locked position shown in FIG. 5.

The arm 43 shown in FIG. 5 has an aperture 47 to which the clutch release cord 37 (see FIG. 1) may be secured. This cord 37 may be used to pivot the clutch arms from the locked position shown to a released position against the bias of the mechanism 41. This pivotal movement causes the axle 44 to rotate in an anti-clockwise direction. To allow such movement, ladder extension rope 35 (see FIG. 1) needs to be used to lift the upper ladder section to allow rung receiving portion 46 to clear the rung 23. Once this occurs and by using the clutch release cord 37, the arms 43 may be pivoted to the left when viewed from the perspective of FIG. 5 and the upper ladder section is then free to be moved relative to the lower ladder section. Once the upper section is in the desired position relative to the lower ladder section, the clutch release cord 37 may be released and the arms 43 return to their locked position from the released position under the influence of the bias previously mentioned. Ladder extension rope 35 may then be released and an appropriate rung 23 then brought into engagement with portion 46.

The rung receiving portions 45 and 46 are arcuate in shape and engage around the rungs 28 and 23 and are unable to accidentally move from the locked to the released position. The arms 43 engage with rungs from both ladder sections.

Figure 6:
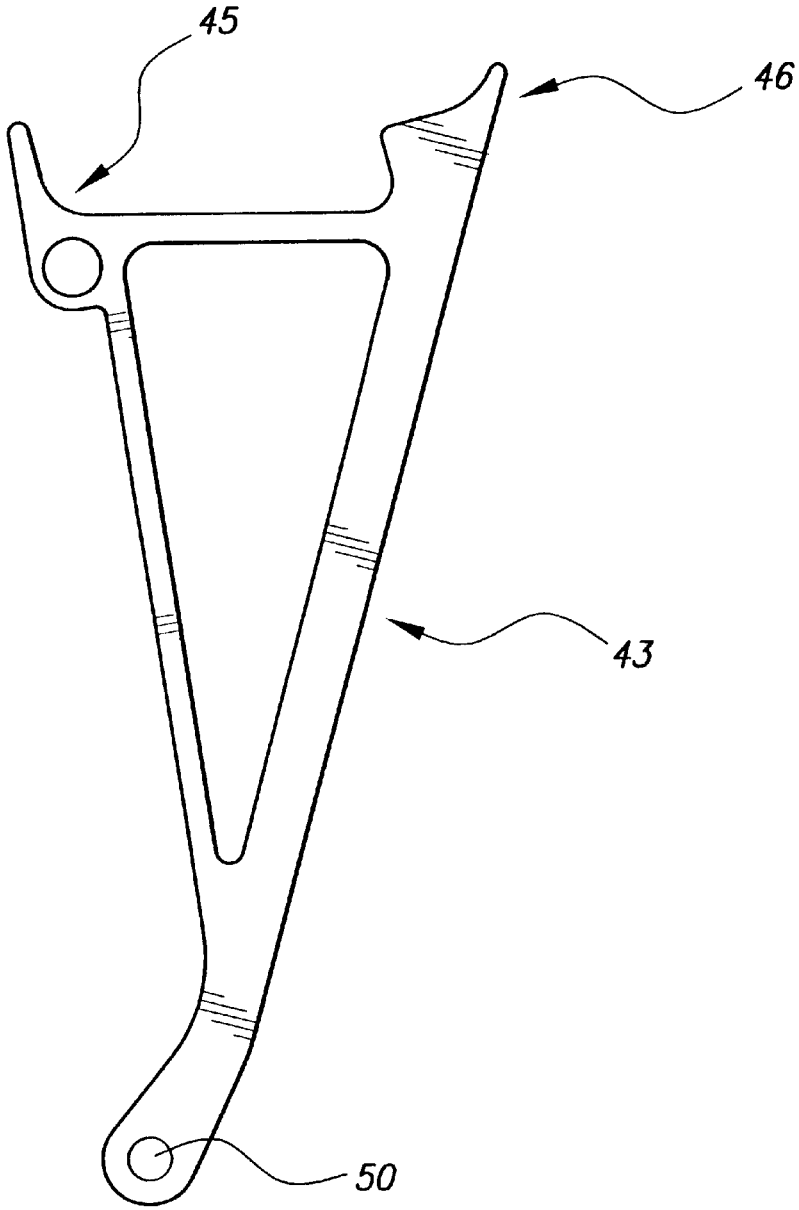
FIG. 6 is a side elevational view of a clutch arm which forms part of a clutch assembly of an embodiment of the invention.

FIG. 6 shows details of a clutch arm 43. The arm 43 has a lowermost portion with an aperture 50 for receiving the axle 44 (see FIG. 5). The axle is fixed relative to the arm 43 and both move as a unit when the arm is pivoted between its two positions.

Figure 7:
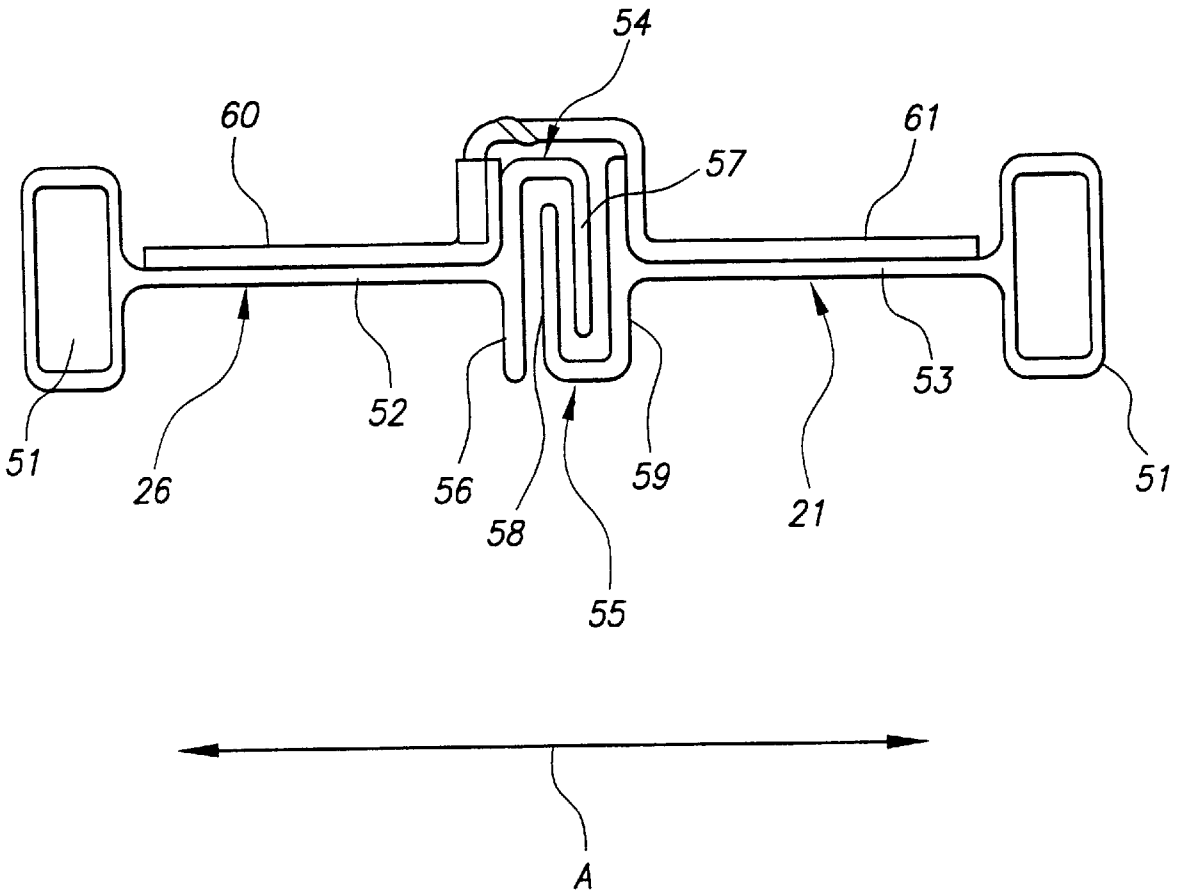
FIG. 7 is an end view of two stiles of the ladder of the invention showing two stop members.

FIG. 7 is an end view of two stiles 26 and 21. The other two stiles 27 and 22 (see FIG. 11) are identical in shape. Stile 21 is one of the stiles of the upper ladder section, while the stile 26 is one of the stiles of the lower ladder section.

Each stile has an enclosed tubular formation 51 at one edge of a web 52, 53 and a hooked formation 54, 55 at the other edge of the web. Formation 54 has spaced flange 56 and 57 while formation 55 has spaced flanges 58, 59. Flange 58 is received between flanges 56 and 57 and flange 57 is received between flanges 58 and 59. With the stiles interlocked in this way, the pairs of stiles which make up the two ladder sections ensure that the ladder sections are held relative to one another so that they may not move in the direction indicated by arrow A in FIG. 7 and are still able to slide relative to each other when the ladder is extended and retracted.

Outer faces of the webs 52 and 53 have stop members 60 and 61 fixed to them adjacent an upper end of the stile 26 and adjacent a lower end of the stile 21. When the upper ladder section is moved to its maximum extended position relative to the lower ladder section, the stop members 60 and 61 come into contact with each other and prevent the ladder sections from moving beyond the maximum extension. The stiles 27 and 22 on the opposite side of the ladder may be provided with similar stop members to members 60 and 61.

Figure 10:
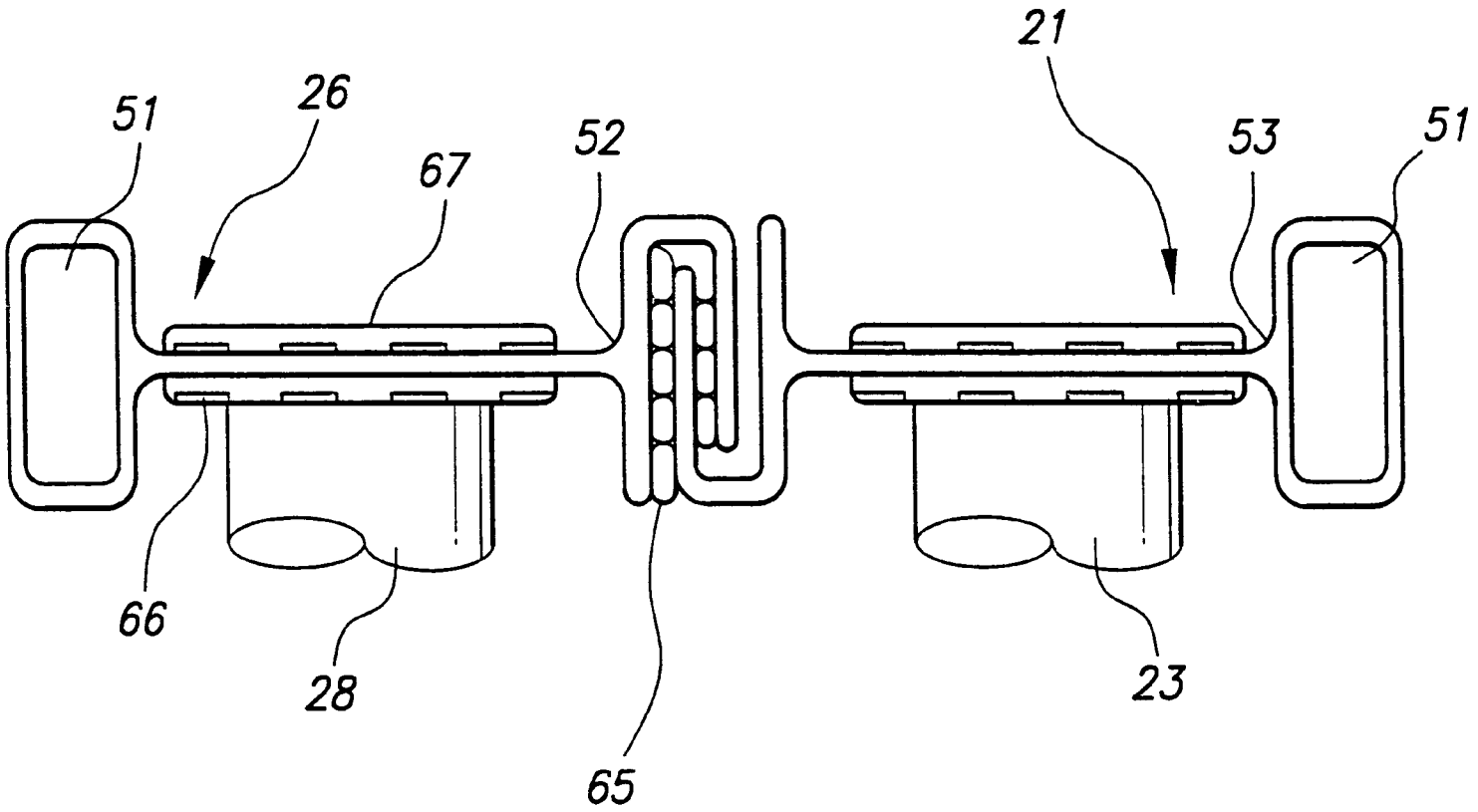
FIG. 10 is an end view of two stiles on one side of the ladder.

FIG. 10 shows further detail of the two stiles 26 and 21. A friction reducing insert 65 may be placed within the interlocking formations. The insert assists in the free relative movement of the ladder sections and takes up some of the space between the formations to inhibit rattling of the ladder sections. The insert may be made from ultra high molecular weight polyethylene or any other suitable material.

End portions of the rungs 28 and 23 are shown in FIG. 10. The rungs pass through apertures in webs 52 and 53. Each rung has an enlargement 66 spaced from an end thereof and which abuts one face of a web of the associated stile. A tubular extension projecting beyond the enlargement 66 is swaged over against the opposite face of the web to form a swaged enlargement 67. The web is locked between these enlargements. All ends of the rungs of the ladder may be configured in this way.

The enclosed sections 51 and the fact that both ladder sections have an identical width results in a particularly strong ladder. The manner in which the ladder sections are locked relative to one another for sliding movement ensures that the exterior of the enclosed sections are free of projections. Thus, when the ladder is stored on a storage rack having storage bars which extend transversely of the ladder, the ladder may freely be drawn across the bars and removed.

Figure 8:
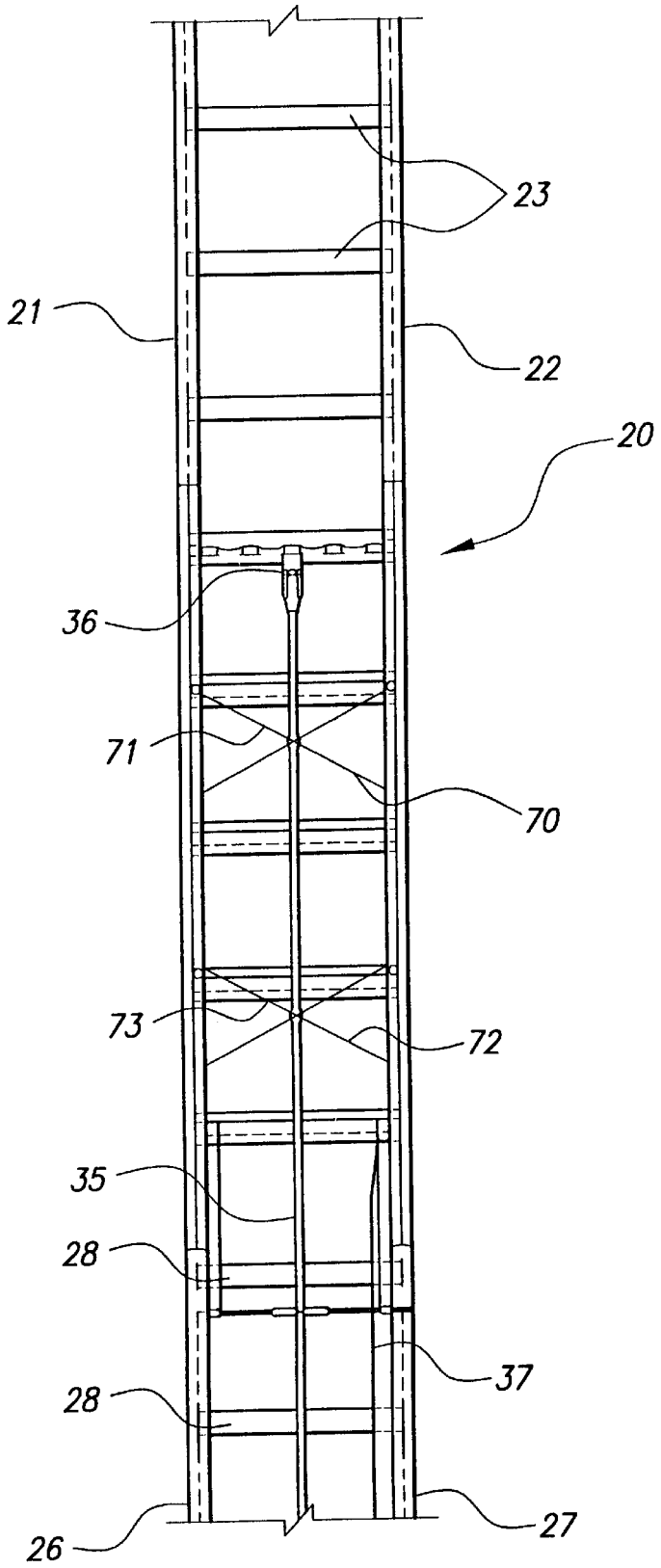
FIG. 8 is a detailed front elevational view of part of the ladder of an embodiment of the invention.
Figure 9:
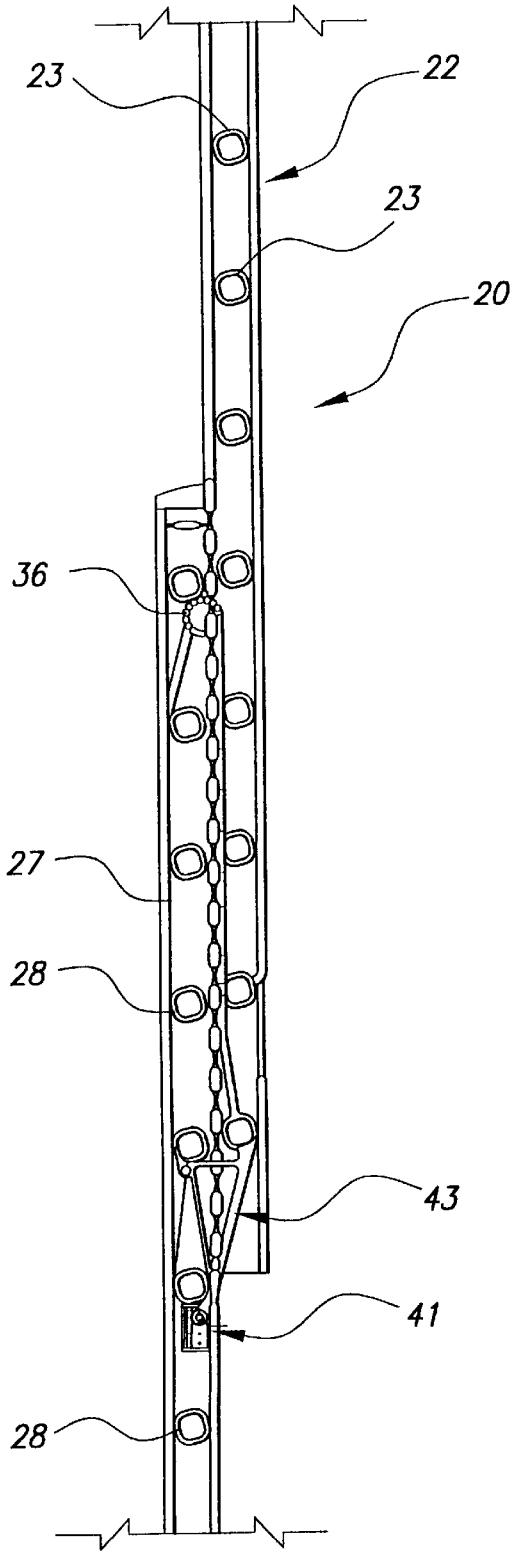
FIG. 9 is a detailed side elevational view of the part of the ladder shown in FIG. 8.
Figures 15A, 15B:
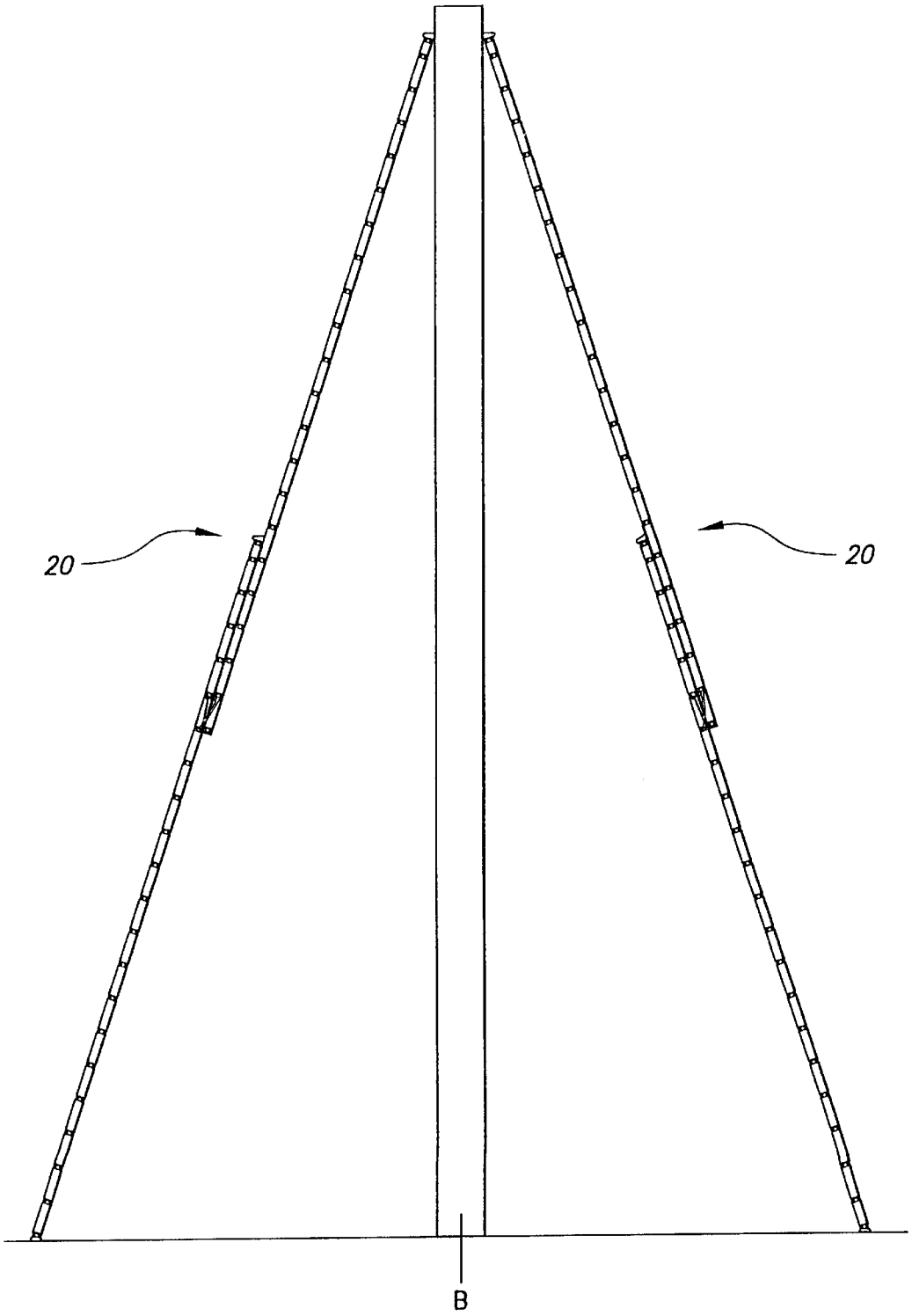
FIGS. 15*a* and 15*b* are side elevational views of two embodiments of the ladder in inclined positions against a wall.

FIGS. 8 and 9 show partial detailed front and side elevational views of a ladder 20 in an extended position. Referring now to FIGS. 15*a* and 15*b*, when the ladder 20 of the invention is extended and placed in an inclined position against a wall (denoted as "B" in FIG. 15), the lower ladder section can be either forward (FIG. 15*a*) or rearward (FIG. 15*b*) of the upper ladder section. Preferably, the lower ladder section is forward of the upper ladder section, as when the user moves down the ladder and over the transition between the two ladder sections, the user steps outwardly away from the wall rather than inwardly as would be the case if the upper ladder section was forward of the lower ladder section as in conventional extension ladders. With the configuration of FIG. 15*a* the user is less likely to miss a step as he progresses down the ladder and moves over the transition between the two ladder sections, thereby reducing the likelihood of an accident occurring.

As well as having the diagonal braces 24 and 25 and 29 and 30 as shown in FIG. 1, the ladder sections have the additional braces 70, 71 near an upper end of the lower ladder section and braces 72, 73 near the lower end of the upper ladder section.

Figure 11:
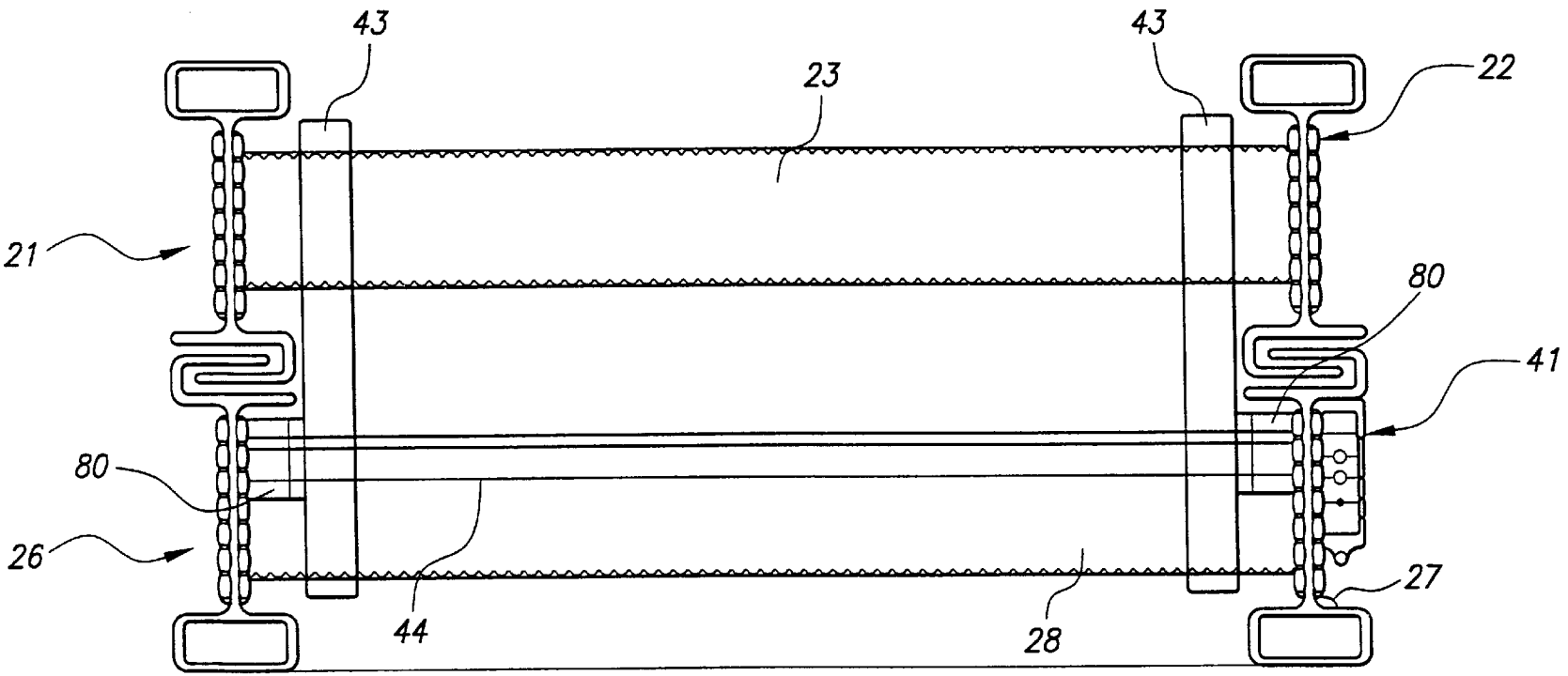
FIG. 11 is an end view of the ladder of FIGS. 1 and 2.
Figure 12:
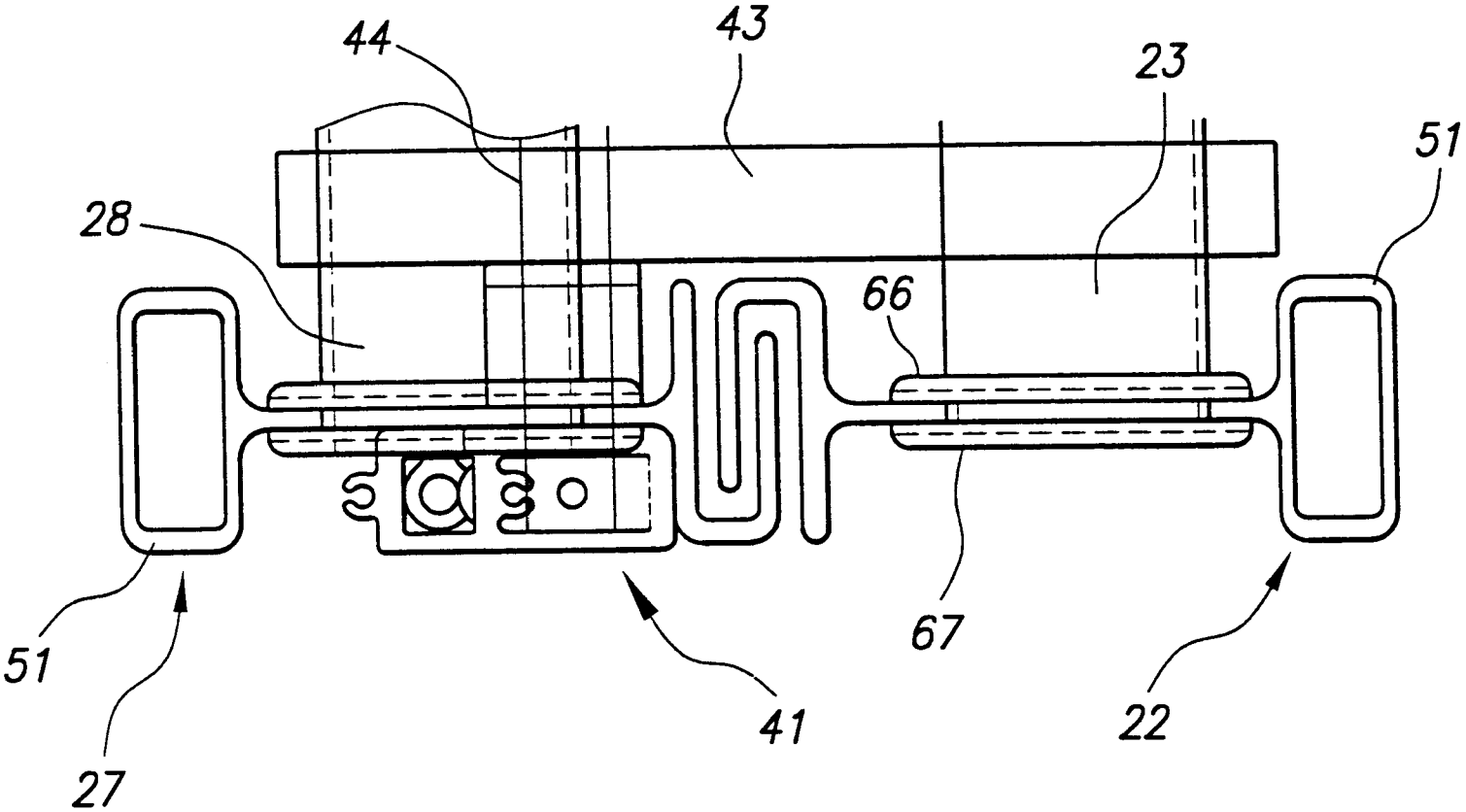
FIG. 12 is a partial end view of the ladder showing details of one side only of the ladder.

FIGS. 11 and 12 are useful in illustrating the clutch mechanism and the clutch locking mechanism 41 used in the ladder of the invention.

Figure 14D:
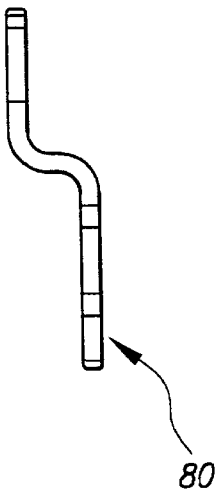
FIGS. 14*a* to 14*d* show details of components of the clutch locking mechanisms and a mounting bracket which forms part of a clutch mechanism.
Figure 14B:
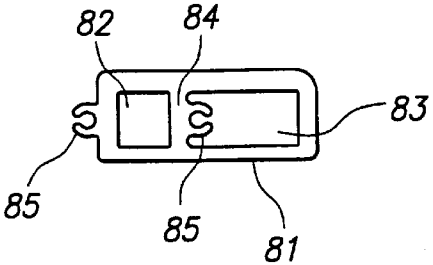
Figure 14C:
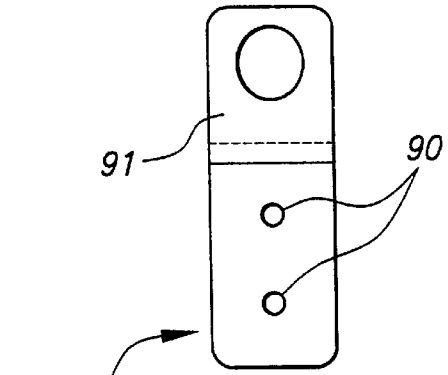

The clutch mechanism includes two clutch arms 43 mounted at spaced locations along axle 44 and two mounting brackets 80 shown in greater detail in FIGS. 14*c* and *d*.

The brackets 80 are secured to inner faces of the webs of stiles 26, 27 of the lower ladder section. Locking mechanism 41 is secured to an outer face of the web of stile 27. Clutch arms 43 rotate along with the axle when the clutch mechanism is operated.

Figure 14A:
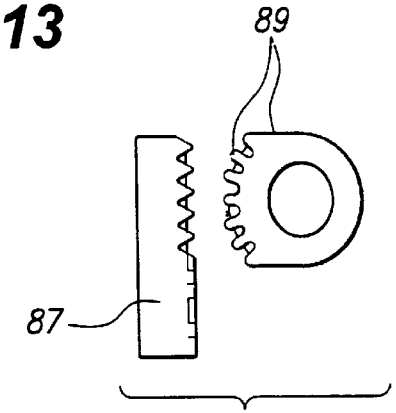
Figure 13:
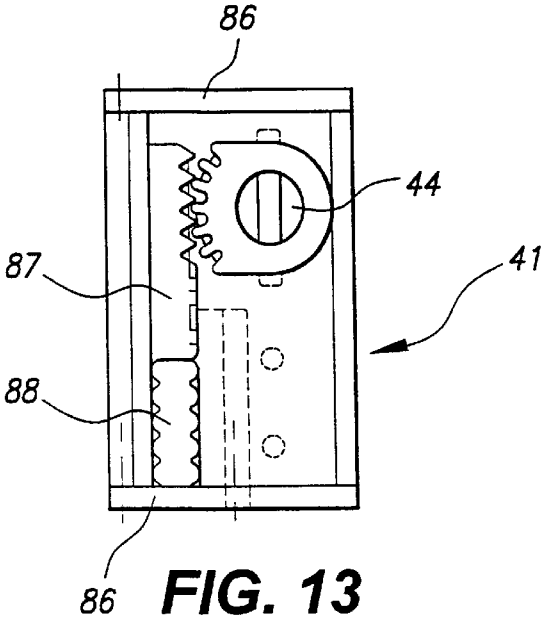
FIG. 13 is an end elevational view of a clutch locking mechanism.

As shown in FIGS. 13 and 14*a, b* and *c*, the locking mechanism 41 has a housing 81 divided into a first zone 82 and a second zone 83 by a partition 84. Screw receiving flutes 85 allow end covers 86 to be attached to the housing 81. A rack 87 and a spring 88 which biases the rack are located in zone 82. A gear 88 with teeth 89 is located in zone 83. The gear 88 is fixed to the axle 44 and rotates with the axle. Bracket 80 has fixing apertures 90 which allow the bracket to be secured to the stile 27 and offset portion 91 has an aperture 92 in which the axle 44 is received.

What is claimed is:

1. An extension ladder having a first ladder section adapted to provide a lower ladder section in use, a second ladder section adapted to provide an upper ladder section in use, the upper and lower ladder sections each having a pair of spaced ladder stiles with rungs extending between each said stile of a pair of stiles at locations along the ladder sections and both said ladder sections having the same width, the lower ladder section in use being located either forwardly or rearwardly of the upper ladder section, a clutch mechanism including two transversely spaced clutch arms fixed to a mounting axle extending across the ladder, wherein the clutch arms and the axle are secured to the lower ladder section, and the axle is mounted for rotation relative to the lower ladder section and the clutch arms extend between the ladder sections and are movable between a locked position for maintaining the upper ladder section at a desired extension relative to the lower ladder section and a released position allowing for movement of the sections relative to one another; and a clutch locking mechanism for biasing the clutch arms into the locked position, wherein the clutch locking mechanism is secured to a stile of the lower ladder section and the mounting axle, the stiles of each ladder section having formations for securing the sections relative to one another and allowing the upper section to be extended and retracted relative to the lower ladder section.

2. The extension ladder of claim 1, wherein the formations are provided along facing edges of the stiles in each ladder section, the formations being continuous and extending the length of the stiles, and consisting of complementary interlocking projections and recesses.

3. The extension ladder of claim 2, wherein the interlocking projections include interlocking flanges extending the length of the stiles, each stile having a pair of interlocking flanges and the flanges of the stiles are arranged in an interleaving fashion to secure the stiles to each other.

4. The extension ladder of claim 3, wherein a friction reducing lining or insert is present between the interlocking flanges of two stiles, thereby assisting the relative sliding action of the ladder sections and minimizing lateral movement of the stiles.

5. The extension ladder as claimed in claim 1, wherein the stiles have a longitudinally extending web and the securing formations are located along one edge of the web and a strengthening formation, to lend rigidity to the ladder, is located at the other edge of the web.

6. The extension ladder as claimed in claim 5, wherein the strengthening formation is an enclosed formation with a rectangular transverse cross section.

7. The extension ladder as claimed in claim 5, wherein maneuverable feet inserts are secured to outer faces of the webs of the stiles of the upper and lower ladder sections.

8. The extension ladder as claimed in claim 1, including strengthening braces adjacent to ends of the upper and lower ladder sections.

9. The extension ladder as claimed in claim 8, wherein the braces consist of a pair of diagonal strengthening struts extending between the stiles of the upper ladder sections and between the stiles of lower ladder sections.

10. The extension ladder as claimed in claim 1, wherein the clutch mechanism is pivotally movable between a locked position and a released position.

11. The extension ladder as claimed in claim 1, wherein the rungs are evenly spaced along the length of the stiles.

12. The extension ladder as claimed in claim 11, including a clutch release cord secured to one of the clutch arms and to a location on the lower ladder section spaced from the one clutch arm and the clutch release cord may be used to move the clutch arms between the locked and the released position.

13. The extension ladder as claimed in claim 12, wherein the clutch arms are mounted to the lower ladder section adjacent an upper end of the lower ladder section, and the other end of the clutch release cord is anchored to a lower most rung of the lower ladder section.

14. The extension ladder as claimed in claim 13, wherein in the locked position the clutch arms engage with a rung of each of the ladder sections.

15. The extension ladder as claimed in claim 14, wherein the clutch arms engage a lower portion of the rungs.

16. The extension ladder as claimed in claim 1, wherein the locking mechanism has a spring for biasing the clutch arms towards the locked position.

17. The extension ladder as claimed in claim 16, wherein the locking mechanism includes a rack associated with the spring, and a gear associated with the rack and the mounting axle, wherein the spring acts upon the rack to cause the gear to rotate the mounting axle.

18. The extension ladder as claimed in claim 1, including a ladder extension rope attached to a lowermost rung of the upper and lower ladder sections, wherein the ladder extension rope is used to extend and retract the upper ladder section relative to the lower ladder section.

19. The extension ladder as claimed in claim 18, including a pulley attached adjacent an upper end of the lower ladder section, wherein the ladder extension rope is trained over the pulley.

* * * * *